US007536748B2

(12) United States Patent
Renke et al.

(10) Patent No.: US 7,536,748 B2
(45) Date of Patent: May 26, 2009

(54) GOOSENECK HINGE ASSEMBLY FOR VEHICLES

(75) Inventors: David T. Renke, Macomb, MI (US); David E. Wheeler, Novi, MI (US); David E. Thomas, Clarkston, MI (US); Mark A. Seiler, Clarkston, MI (US); Robert D. Flatley, Commerce Twp., MI (US)

(73) Assignee: General Motors Corporation, Detroit, MI (US)

( * ) Notice: Subject to any disclaimer, the term of this patent is extended or adjusted under 35 U.S.C. 154(b) by 198 days.

(21) Appl. No.: 11/104,840

(22) Filed: Apr. 13, 2005

(65) Prior Publication Data

US 2006/0230578 A1 Oct. 19, 2006

(51) Int. Cl.
*E05F 1/08* (2006.01)

(52) U.S. Cl. ..... 16/289; 16/308

(58) Field of Classification Search ..... 16/366, 16/311, 368–370, 347, 265, 287–289, 277, 16/235, 239; 49/248, 386, 339–341, 349, 49/348, 385, 360, 280, 501

See application file for complete search history.

(56) References Cited

U.S. PATENT DOCUMENTS

| | | | | |
|---|---|---|---|---|
| 2,479,437 | A * | 8/1949 | Vigmostad et al. | 16/289 |
| 5,235,725 | A * | 8/1993 | Rees | 16/298 |
| 5,243,738 | A * | 9/1993 | Kiefer | 16/298 |
| 5,419,012 | A * | 5/1995 | Lewis | 16/306 |
| 5,967,586 | A * | 10/1999 | Duffy et al. | 296/76 |
| 6,230,364 | B1 * | 5/2001 | Cheal | 16/289 |
| 6,269,521 | B1 * | 8/2001 | Gabel | 16/287 |
| 6,382,704 | B1 * | 5/2002 | Nastasoiu | 296/146.11 |
| 6,401,299 | B1 * | 6/2002 | Schwarz | 16/335 |
| 6,618,904 | B1 * | 9/2003 | Nagy | 16/370 |
| 7,147,266 | B2 * | 12/2006 | Huntsman et al. | 296/146.1 |
| 2001/0005920 | A1 * | 7/2001 | Kim | 16/334 |
| 2003/0167598 | A1 * | 9/2003 | Koestler et al. | 16/289 |
| 2004/0088826 | A1 * | 5/2004 | Schlegel | 16/366 |
| 2005/0172453 | A1 * | 8/2005 | Duffy | 16/307 |

* cited by examiner

*Primary Examiner*—Chuck Y. Mah

(57) ABSTRACT

A gooseneck hinge assembly for a closure of a vehicle includes a body side strap adapted to be connected to a vehicle body of the vehicle and a closure side strap having a gooseneck shape adapted to be connected to a closure for closing an aperture in the vehicle body. The gooseneck hinge assembly also includes a pivot pin to pivotally connect the closure side strap to the body side strap to allow rotational movement therebetween. The gooseneck hinge assembly further includes a spring interconnecting the body side strap and the closure side strap to counterbalance a weight of the closure when opening and closing the aperture.

6 Claims, 7 Drawing Sheets

GOOSENECK HINGE ASSEMBLY FOR VEHICLES

TECHNICAL FIELD

The present invention relates generally to hinges for vehicles and, more particularly, to a gooseneck hinge assembly for a vehicle.

BACKGROUND OF THE INVENTION

It is known to provide a closure such as a decklid for a vehicle to open and close a rear compartment or trunk of a vehicle body of the vehicle. Typically, the deck lid is attached to the vehicle body with at least one, preferably a pair of laterally spaced hinges. Currently, the decklid hinges are of a goose-neck type for allowing motion of the decklid from a fully open position to a fully closed position and for counterbalancing a weight of the decklid. However, these goose-neck hinges require the use of additional torsion bars that require installation at a vehicle assembly plant. The assemblers must preload or wind the torsion bars before final assembly to the overall vehicle, which is undesired.

Therefore, it is desirable to provide a gooseneck hinge for a closure of a vehicle that eliminates the need for external torsion bars. It is also desirable to provide a gooseneck hinge that reduces assembly labor. Therefore, there is a need in the art to provide a gooseneck hinge for a vehicle that meets these desires.

SUMMARY OF THE INVENTION

It is, therefore, one object of the present invention to provide a new gooseneck hinge assembly for a closure of a vehicle.

It is another object of the present invention to provide a gooseneck hinge assembly for a closure of a vehicle that improves the opening and closing effort of the closure.

To achieve the foregoing objects, the present invention is a gooseneck hinge assembly for a closure of a vehicle including a body side strap adapted to be connected to a vehicle body of the vehicle and a closure side strap having a gooseneck shape adapted to be connected to a decklid for closing an aperture in the vehicle body. The gooseneck hinge assembly also includes a pivot pin to pivotally connect the closure side strap to the body side strap to allow rotational movement therebetween. The gooseneck hinge assembly further includes a spring interconnecting the body side strap and the closure side strap to counterbalance a weight of the decklid when opening and closing the aperture.

One advantage of the present invention is that a new gooseneck hinge assembly is provided for a closure such as a decklid or liftgate of a vehicle. Another advantage of the present invention is that the gooseneck hinge assembly has an integral spring that eliminates a need for external torsion bars. Yet another advantage of the present invention is that the gooseneck hinge assembly improves operator opening and closing efforts for vehicle closures such as decklids or liftgates on a vehicle. Still another advantage of the present invention is that the gooseneck hinge assembly has improved overall vehicle packaging of the hinges under the vehicle "package shelf". A further advantage of the present invention is that the gooseneck hinge assembly reduces mass and cost including assembly labor. Yet a further advantage of the present invention is that the gooseneck hinge assembly has one hinge assembly part number for both right hand (RH) and left hand (LH) parts.

Other objects, features, and advantages of the present invention will be readily appreciated, as the same becomes better understood, after reading the subsequent description taken in conjunction with the accompanying drawings.

BRIEF DESCRIPTION OF THE DRAWINGS

FIG. 6 is an elevational view of the gooseneck hinge assembly of FIG. 5 illustrated in a closed operating position and an open operating position.

DESCRIPTION OF THE PREFERRED EMBODIMENT

Figure 1:
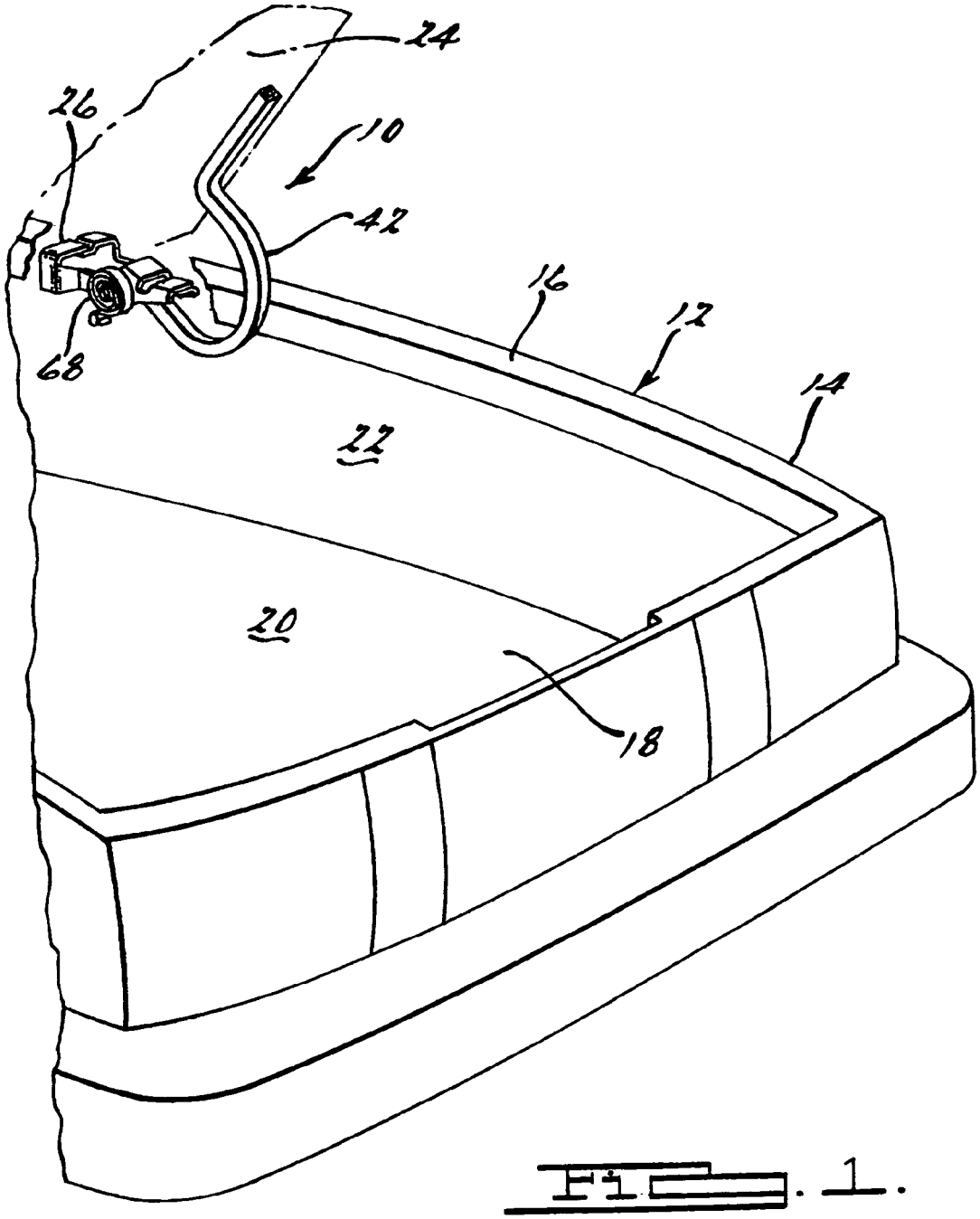
FIG. 1 is a gooseneck hinge assembly, according to the present invention, illustrated in operational relationship with a vehicle.

Referring to the drawings and in particular FIG. 1, one embodiment of a gooseneck hinge assembly 10, according to the present invention, is shown for a vehicle such as an automotive vehicle, generally indicated at 12. Such vehicles 12 typically include a vehicle body 14 (partially shown) forming a trunk or rear compartment 16. The rear compartment 16 has an opening such as a recess 18 therein. The recess 18 is formed by a floorpan 20 and side walls 22 extending upwardly from the floorpan 20 and generally perpendicular thereto. The vehicle body 14 also includes a closure such as a decklid 24 closing the recess 18. The decklid 24 is attached to the rear compartment 16 of the vehicle body 14 by at least one, preferably a pair of laterally spaced gooseneck hinge assemblies 10. It should be appreciated that only one gooseneck hinge assembly 10 is illustrated in FIG. 1 and will be subsequently described. It should also be appreciated that, except for the gooseneck hinge assembly 10, the vehicle 12 is conventional and known in the art.

Figure 2:
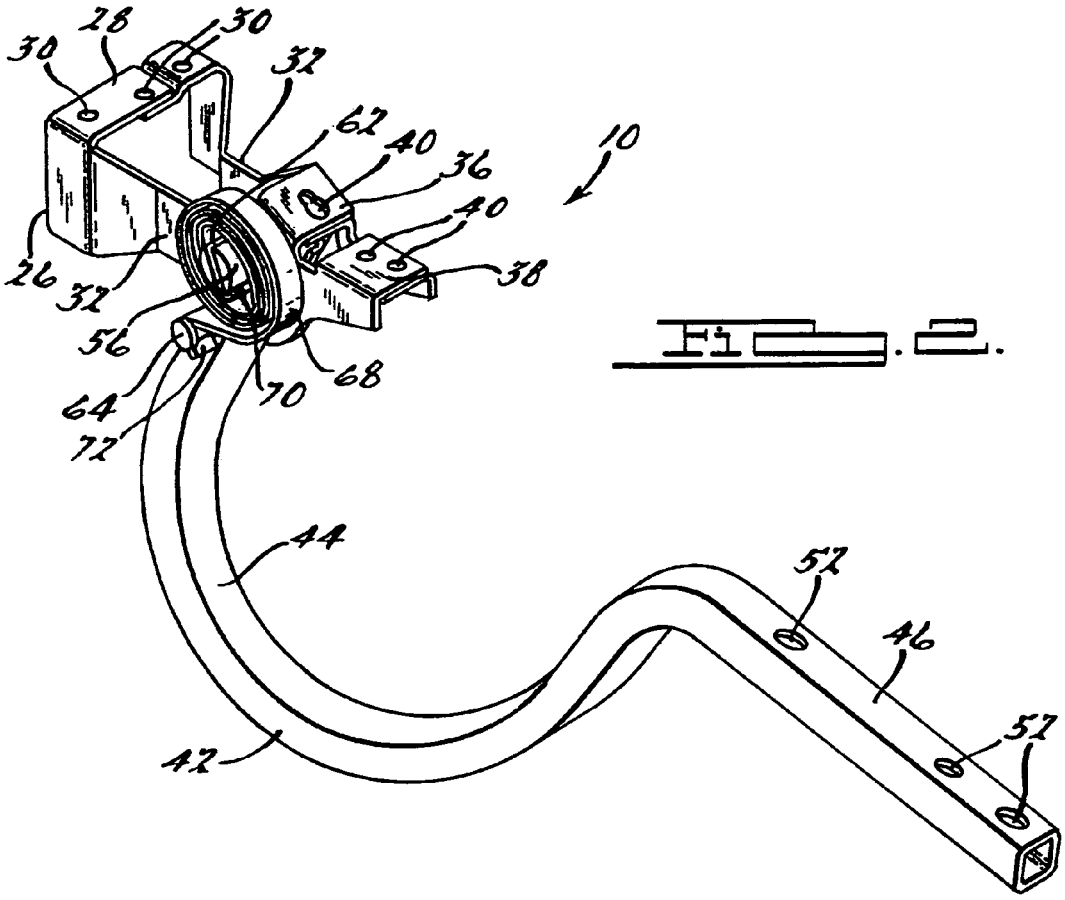
FIG. 2 is a perspective view of the gooseneck hinge assembly of FIG. 1.
Figure 3:
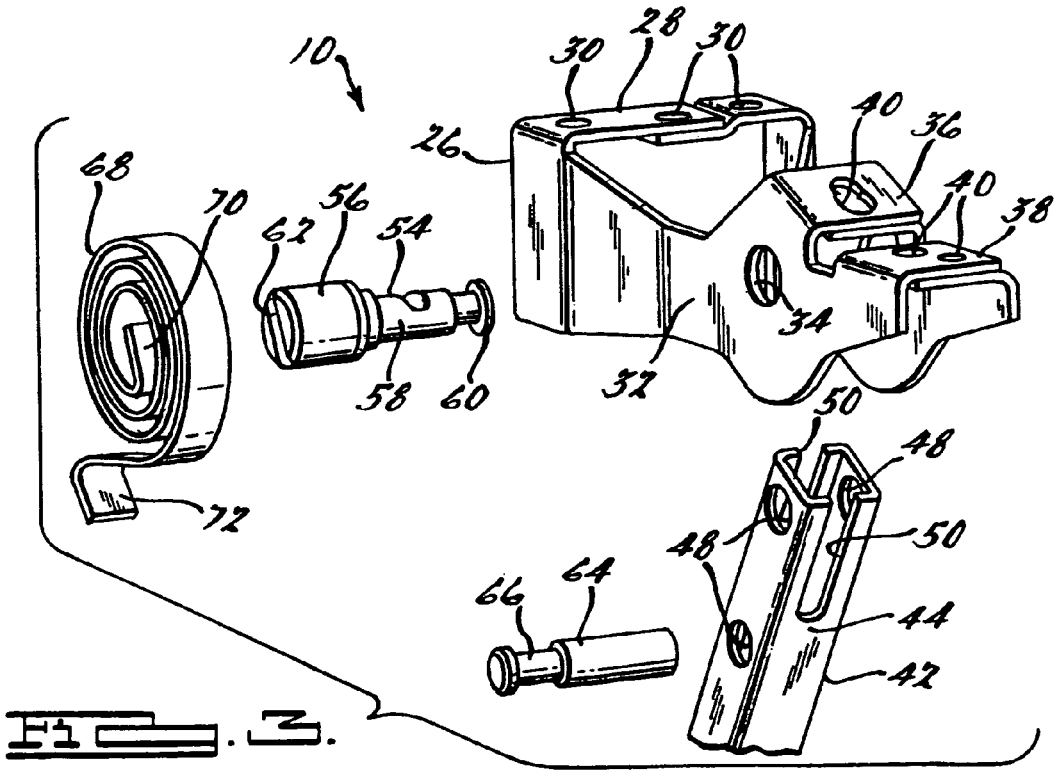
FIG. 3 is an exploded perspective view of a portion of the gooseneck hinge assembly of FIG. 2.

Referring to FIGS. 2 and 3, the gooseneck hinge assembly 10 includes a body side bracket or strap 26 to be mounted to the vehicle body 14. The body side strap 26 is generally rectangular in shape. The body side strap 26 has a base portion 28 with a generally inverted "U" shape. The base portion 28 has at least one, preferably a plurality of apertures 30 extending therethrough for a function to be described. The body side strap 26 also has a pair of opposed side portions 32 extending longitudinally from the base portion 28. Each of the side portions 32 has at least one aperture 34 extending therethrough for a function to be described. The body side strap 26 also has a first support portion 36 extending laterally between the side portions 32 and a second support portion 38 spaced longitudinally from the first support portion 36 and extending laterally between the side portions 32. The first support portion 36 and second support portion 38 have a generally inverted "U" shape. Each of the first support portion 36 and second support portion 38 have at least one, preferably a plurality of apertures 40 extending therethrough for a function to be described.

The gooseneck hinge assembly 10 also includes at least one, preferably a plurality of fasteners (not shown) such as bolts to attach the body side strap 26 to the vehicle body 14. Each of the fasteners extends through some of the apertures 30 and 40 in the body side strap 26 and corresponding apertures (not shown) in the vehicle body 14 and is engaged by nuts (not shown) to prevent the fasteners from disengaging the apertures 30 and 40. The body side strap 26 is made of a rigid material such as metal. The body side strap 26 may be formed in one or more pieces joined together by a suitable mechanism such as welding. The body side strap 26 is integral and one-piece. It should be appreciated that the fasteners are conventional and known in the art.

The gooseneck hinge assembly 10 also includes a closure side bracket or strap 42 to allow the decklid 24 to be attached to the body side strap 26. The closure side strap 42 has a generally "gooseneck" shape. The closure side strap 42 is a hollow member having a generally rectangular cross-sectional shape. The closure side strap 42 has a generally arcuate base portion 44 and an attachment portion 46 extending longitudinally from one end of the base portion 44. The base portion 44 has at least one, preferably a plurality of apertures 48 extending therethrough near one end thereof for a function to be described. The base portion 44 also has a pair of opposed slots 50 extending therein from one end thereof on sides adjacent the apertures 48. The attachment portion 46 includes at least one, preferably a plurality of apertures 52 extending therethrough for a function to be described.

The gooseneck hinge assembly 10 also includes at least one, preferably a plurality of fasteners (not shown) such as bolts to attach the closure side strap 42 to the decklid 24. Each of the fasteners extends through some of the apertures 52 in the attachment portion 46 and corresponding apertures (not shown) in the decklid 24 and is engaged by nuts (not shown) to prevent the fasteners from disengaging the apertures. The closure side strap 42 is made of a rigid material such as metal. The closure side strap 42 is integral and one-piece. It should be appreciated that the fasteners are conventional and known in the art.

The gooseneck hinge assembly 10 also includes at least one first or pivot pin 54 to pivotally attach the closure side strap 42 to the body side strap 26 at a forward end thereof. The pivot pin 54 includes a head portion 56 extending radially, a shaft portion 58 extending generally axially from the head portion 56, and a flange portion 60 extending radially outwardly near one end thereof. The head portion 56 has a slot 62 therein for a function to be described. The shaft portion 58 extends through a pair of opposed apertures 34 and 48 of the body side strap 26 and closure side strap 42, respectively such that the head portion 56 is disposed on one side of the body side strap 26 and the flange portion 60 is disposed on the other side of the body side strap 26. The pivot pin 54 is made of a rigid material such as metal.

The gooseneck hinge assembly 10 also includes a second or spring pin 64 to guide the pivoting action of the closure side strap 42 along a predetermined path. The spring pin 64 extends longitudinally and a recessed or smaller diameter portion 66 therein for a function to be described. The spring pin 64 extends through a pair of opposed apertures 48 in the closure side strap 42 such that the recessed portion 66 is disposed outside the closure side strap 42 on the same side as the head portion 56 of the pivot pin 54. The spring pin 64 is made of a rigid material such as metal.

The gooseneck hinge assembly 10 further includes a spring 68 to power the decklid 24 to an open position by applying a force to the closure side strap 42. The spring 68 is of a clock type. The spring 68 is disposed about the-pivot pin 54 and has a first end 70 disposed in the slot 62 of the head portion 56 of the pivot pin 54 and a second end 72 disposed in the recessed portion 66 about the spring pin 64. It should be appreciated that the spring 68 applies a force to counterbalance the weight of the decklid 24.

Figure 4:
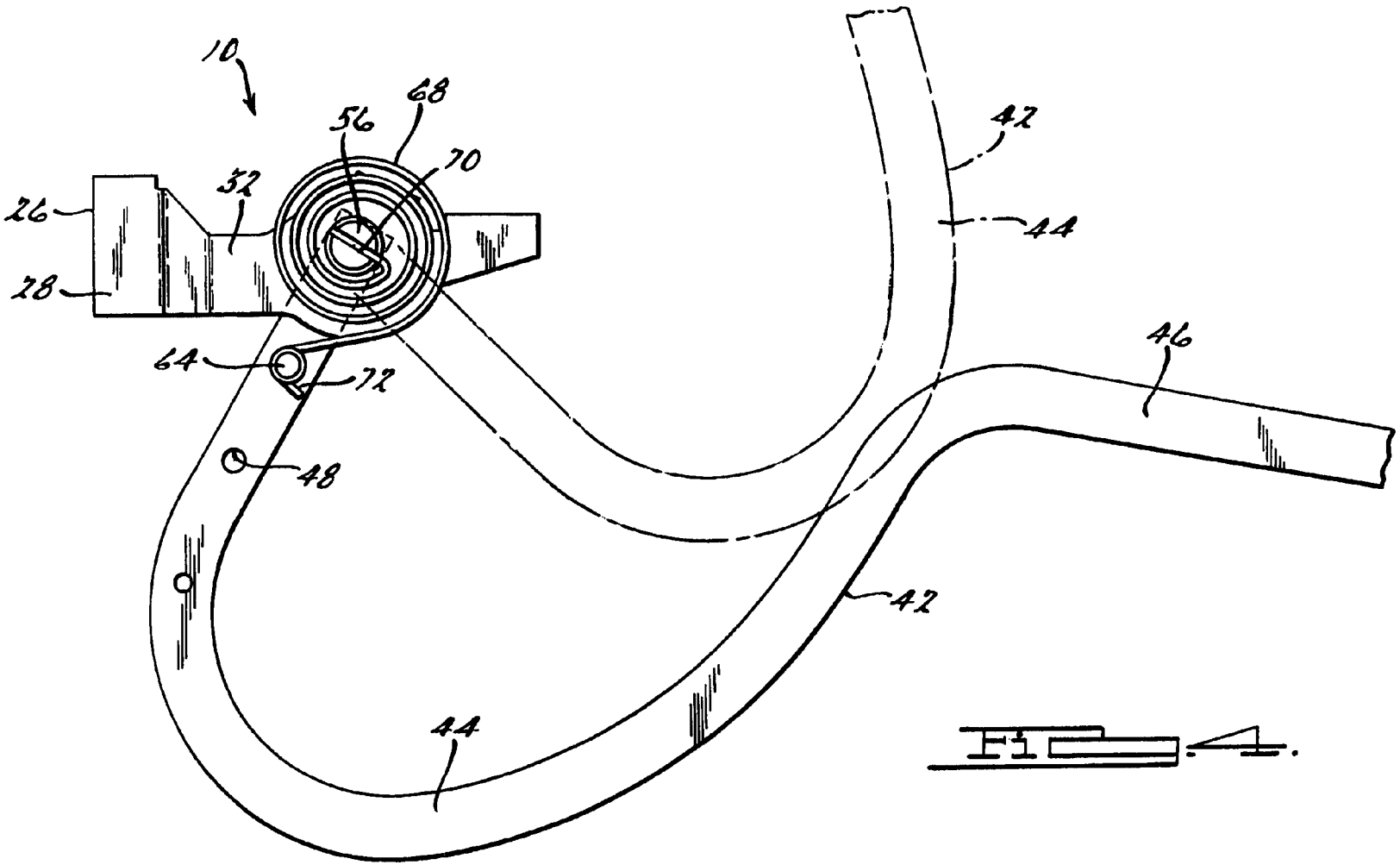
FIG. 4 is an elevational view of the gooseneck hinge assembly of FIG. 1 illustrated in a closed operating position and an open operating position.

Referring to FIG. 4, the gooseneck hinge assembly 10 is shown in open (phantom lines) and closed (solid lines) operating positions, respectively. With the gooseneck hinge assembly 10, to open the decklid 24, the user applies a force to the decklid 24 and the spring 68 applies a spring force to the closure side strap 42 via the spring pin 64 to open the decklid 24 to the open position. To close the decklid 24, the user applies a force to the decklid 24 and the spring 68 counterbalances the weight of the decklid 24 to move the decklid 24 to the closed position. It should be appreciated that the decklid 24 can be shut manually like any other decklid. It should also be appreciated that the gooseneck hinge assembly 10 allows the decklid 24 to be rotated open and closed. It should further be appreciated that, if desired, an automatically opening closure could be obtained by providing enough spring force and/or moment arm. It should further be appreciated that the gooseneck hinge assembly 10 has an integral spring 68 that eliminates the need for external torsion bars.

Figure 5:
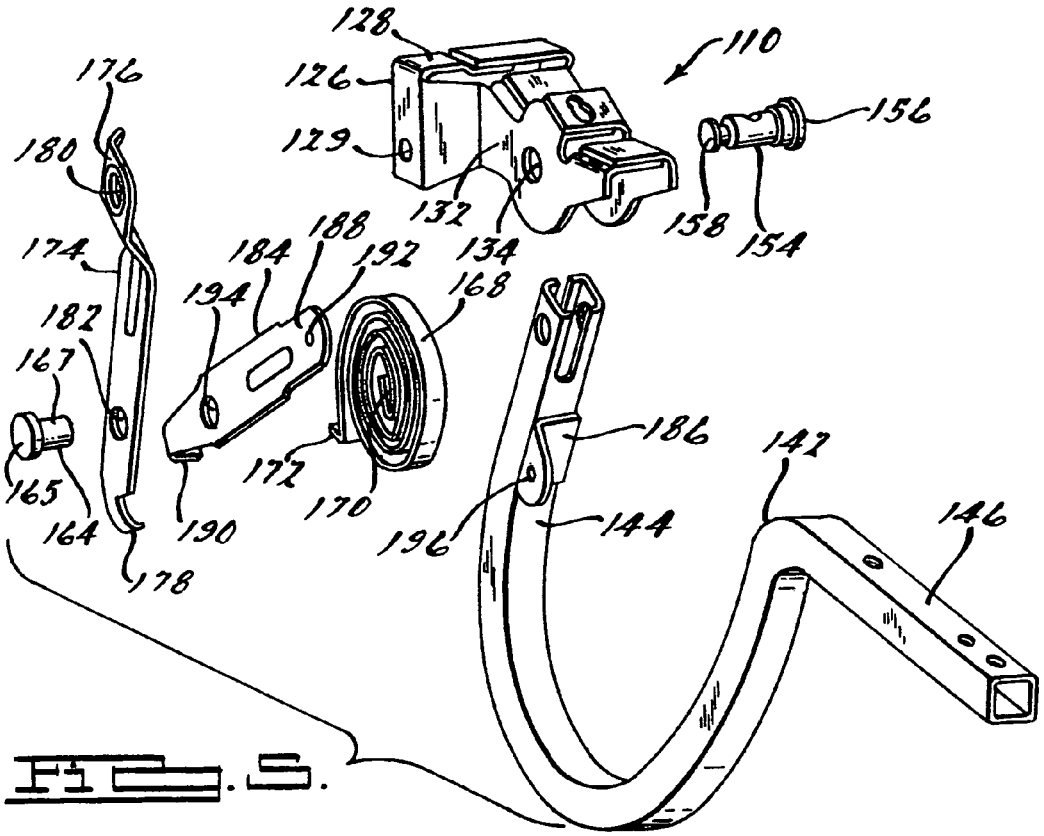
FIG. 5 is an exploded perspective view of another embodiment, according to the present invention, of the gooseneck hinge assembly of FIG. 1.

Referring to FIGS. 5 and 6, another embodiment, according to the present invention, of the gooseneck hinge assembly 10 is shown. Like parts of the gooseneck hinge assembly 10 have like reference numerals increased by one hundred (100). In this embodiment, the gooseneck hinge assembly 110 includes a body side bracket or strap 126 to allow the hinge assembly 110 to be mounted to the vehicle body 14. The body side strap 126 has a base portion 128 with a generally inverted "U" shape. The base portion 128 has at least one aperture 129 extending therethrough on one side thereof for a function to be described. The body side strap 126 also has a pair of opposed side portions 132 extending longitudinally from the base portion 128. Each of the side portions 132 has at least one aperture 134 extending therethrough for a function to be described. The gooseneck hinge assembly 110 also includes at least one, preferably a plurality of fasteners (not shown) such as bolts to attach the body side strap 126 to the vehicle body 14.

The gooseneck hinge assembly 110 includes a closure side bracket or strap 142 to allow the decklid 24 to be attached to the body side strap 126. The closure side strap 142 has a generally arcuate base portion 144 and an attachment portion 146 extending longitudinally from one end of the base portion 144. The gooseneck hinge assembly 110 also includes at least one, preferably a plurality of fasteners (not shown) such as bolts to attach the closure side strap 142 to the decklid 124.

The gooseneck hinge assembly 110 also includes at least one first or pivot pin 154 to pivotally attach the closure side strap 142 to the body side strap 126 at a forward end thereof. The pivot pin 154 includes a head portion 156 extending radially, a shaft portion 158 extending generally axially from the head portion 156, and a flange portion 160 extending radially outwardly near one end thereof.

The gooseneck hinge assembly 110 includes a body lever 174 connected to the body side strap 126. The body lever 174 is generally rectangular in shape. The body lever 174 has a first end 176 extending laterally outwardly in one direction and a second end 178 extending laterally outwardly in an opposite direction. The first end 176 has an aperture 180 extending therethrough. The pivot pin 154 extends through the aperture 180 in the body lever 174 such that the flange portion 160 is disposed on one side thereof. The body lever 174 has an aperture 182 spaced between the first end 176 and the second end 178 and extending therethrough. The body lever 174 is made of a rigid material such as metal. The body lever 174 is integral and one-piece. The gooseneck hinge assembly 110 includes a fastener 183 (FIG. 6) extending through the apertures 180 and 129 of the body lever 174 and body side strap 126, respectively, to connect the body lever 174 and body side strap 126 together.

The gooseneck hinge assembly 110 includes a closure lever 184 connected to the body lever 174 and a bracket 186 connected to the closure side strap 142. The closure lever 184 is generally rectangular in shape. The closure lever 184 has a first end 188 extending axially and a second end 190 extending laterally outwardly. The first end 188 has an aperture 192 extending therethrough. The closure lever 184 has an aperture 194 spaced between the first end 188 and the second end 190 and extending therethrough. The closure lever 184 is made of a rigid material such as metal. The closure lever 184 is integral and one-piece.

The gooseneck hinge assembly 110 also includes a second or spring pin 164 to guide the pivoting action of the closure side strap 142 along a predetermined path. The spring pin 164 has a head portion 165 extending radially outwardly and a shaft portion 167 extending axially from the head portion 165. The shaft portion 167 has a slot (not shown) therein for a function to be described. The shaft portion 167 extends through the apertures 182 and 194 in the body lever 174 and the closure lever 184, respectively, to connect the body lever 174 and closure lever 184 together.

The gooseneck hinge assembly 110 includes the bracket 186 connected to the base portion 144 of the closure side strap 142. The bracket 186 is generally "L" shaped. The bracket .186 has an aperture 196 extending therethrough. The bracket 186 is made of a rigid material such as metal. The bracket 186 is integral and one-piece. The bracket 186 is connected to the closure side strap 142 by a suitable mechanism such as welding. The gooseneck hinge assembly 110 includes a fastener 198 (FIG. 6) extending through the apertures 192 and 196 of the closure lever 184 and bracket 186, respectively, to connect the closure lever 184 and bracket 186 together.

The gooseneck hinge assembly 110 further includes a spring 168 to power the decklid 24 to an open position by applying a force to the closure side strap 142 via the closure lever 184 and bracket 186. The spring 168 is of a clock type. The spring 168 has a first end 170 disposed about the shaft portion 167 of the spring pin 164 and a second end 122 disposed about the second end 190 of the closure lever 184. It should be appreciated that the spring 168 applies a force to counterbalance the weight of the decklid 24.

Referring to FIG. 6, the gooseneck hinge assembly 110 is shown in closed (solid lines) and open (phantom lines) operating positions, respectively. With the gooseneck hinge assembly 110, to open the decklid 24, the user applies a force to the decklid 24 and the spring 168 applies a spring force to the closure side strap 142 via the closure lever 184 and bracket 186 to open the decklid 24 to the open position. To close the decklid 24, the user applies a force to the decklid 24 and the spring 168 counter-balances the weight of the decklid 24 to move the decklid 24 to the closed position. It should be appreciated that the gooseneck hinge assembly 110 allows the decklid 24 to be rotated open and closed. It should also be appreciated that the gooseneck hinge assembly 110 has a moment arm between the closure side strap 142 and the body lever 174 (i.e., between pins 183 and 154) that is greater in the closed position than in the open position.

Figure 7:
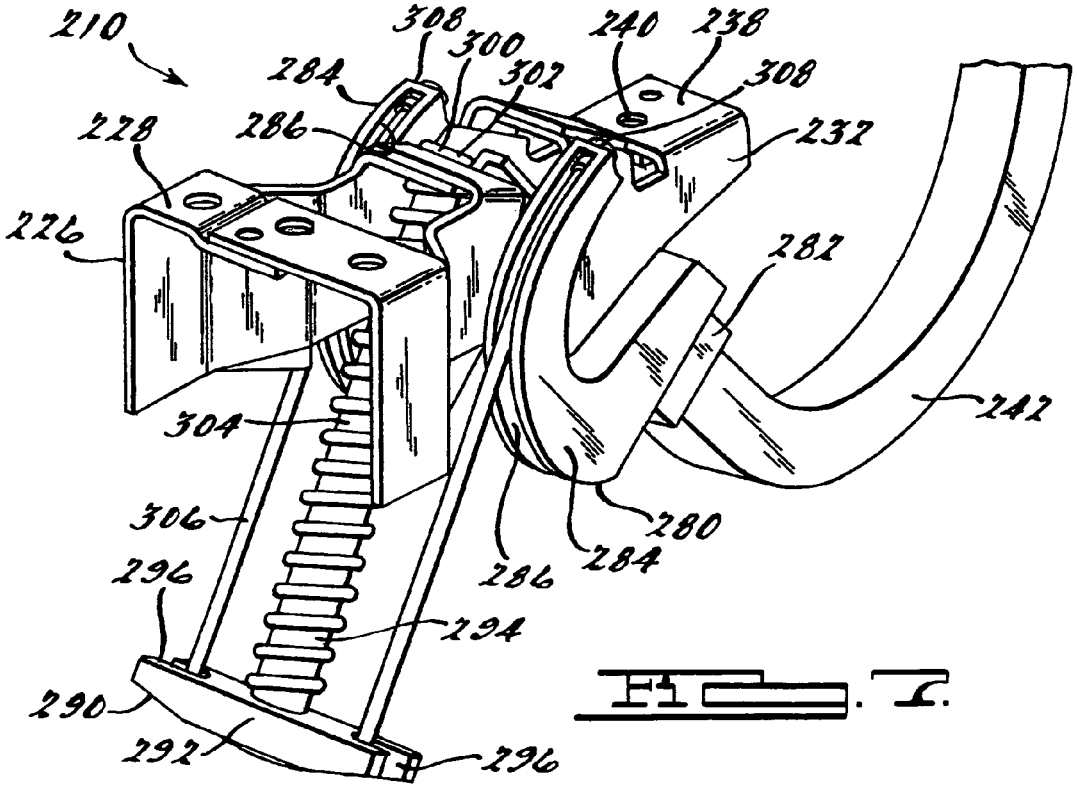
FIG. 7 is a perspective view of yet another embodiment, according to the present invention, of the gooseneck hinge assembly of FIG. 1.
Figure 5:
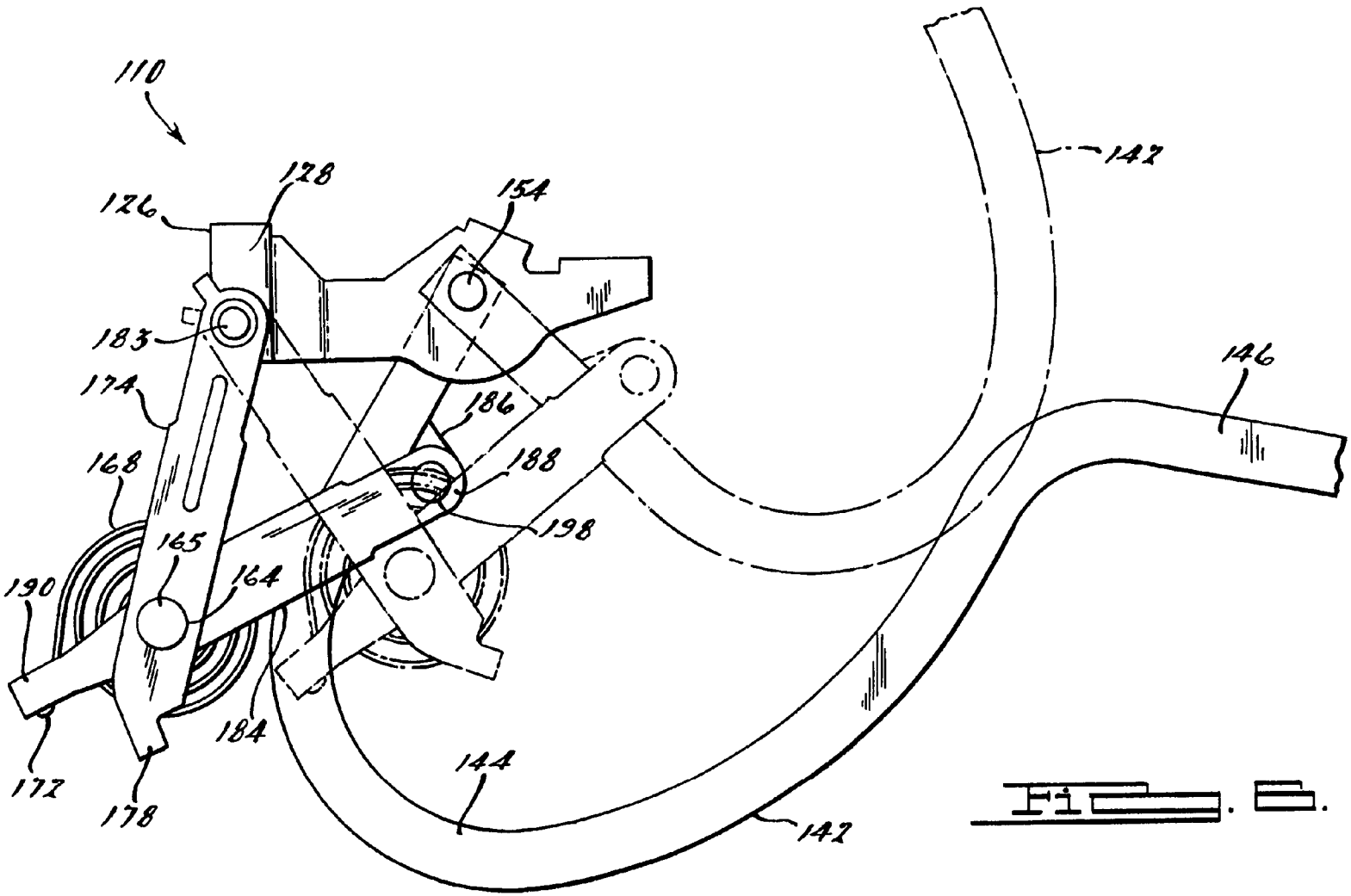
Figure 8:
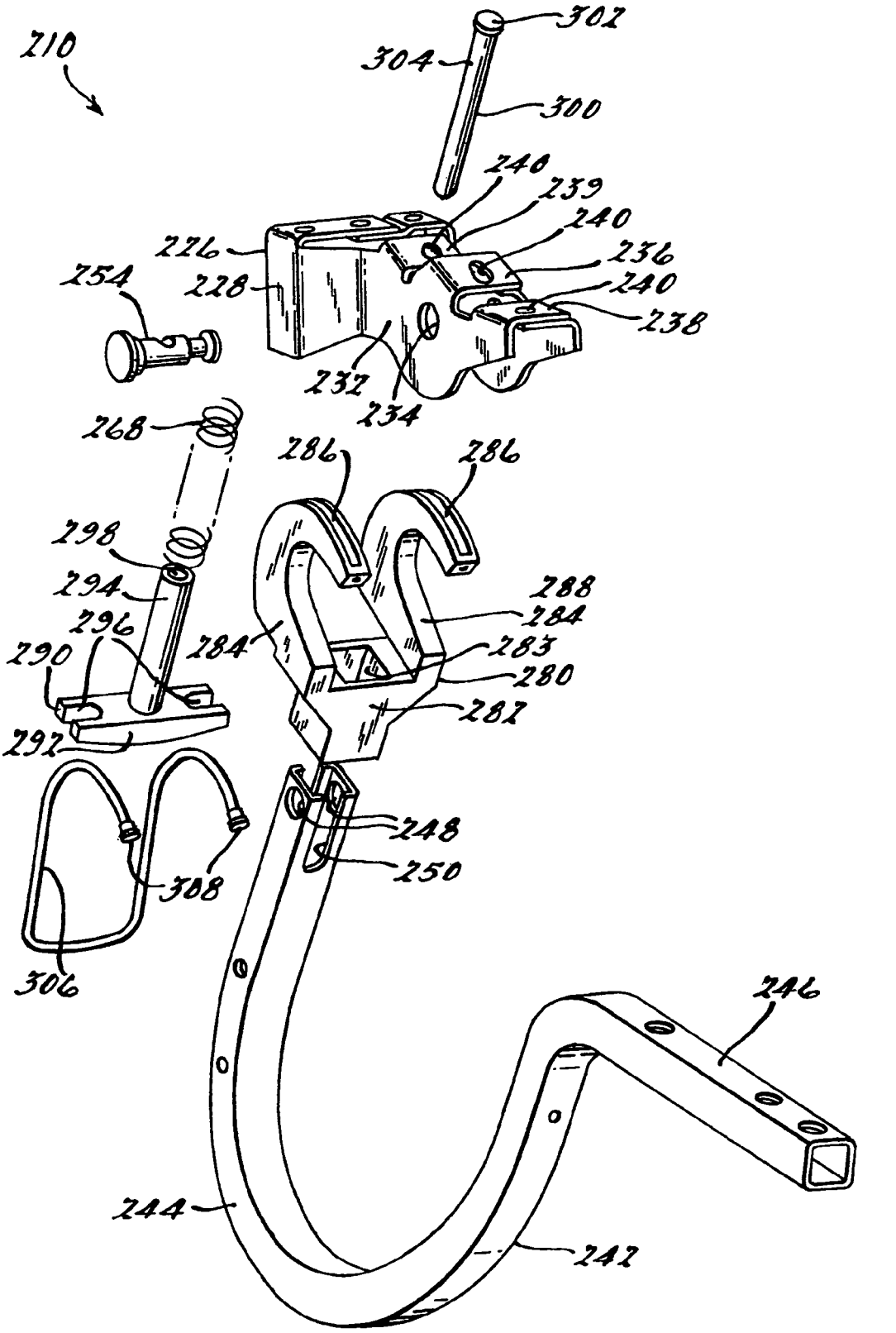
FIG. 8 is an exploded perspective view of the gooseneck hinge assembly of FIG. 7.
Figure 9:
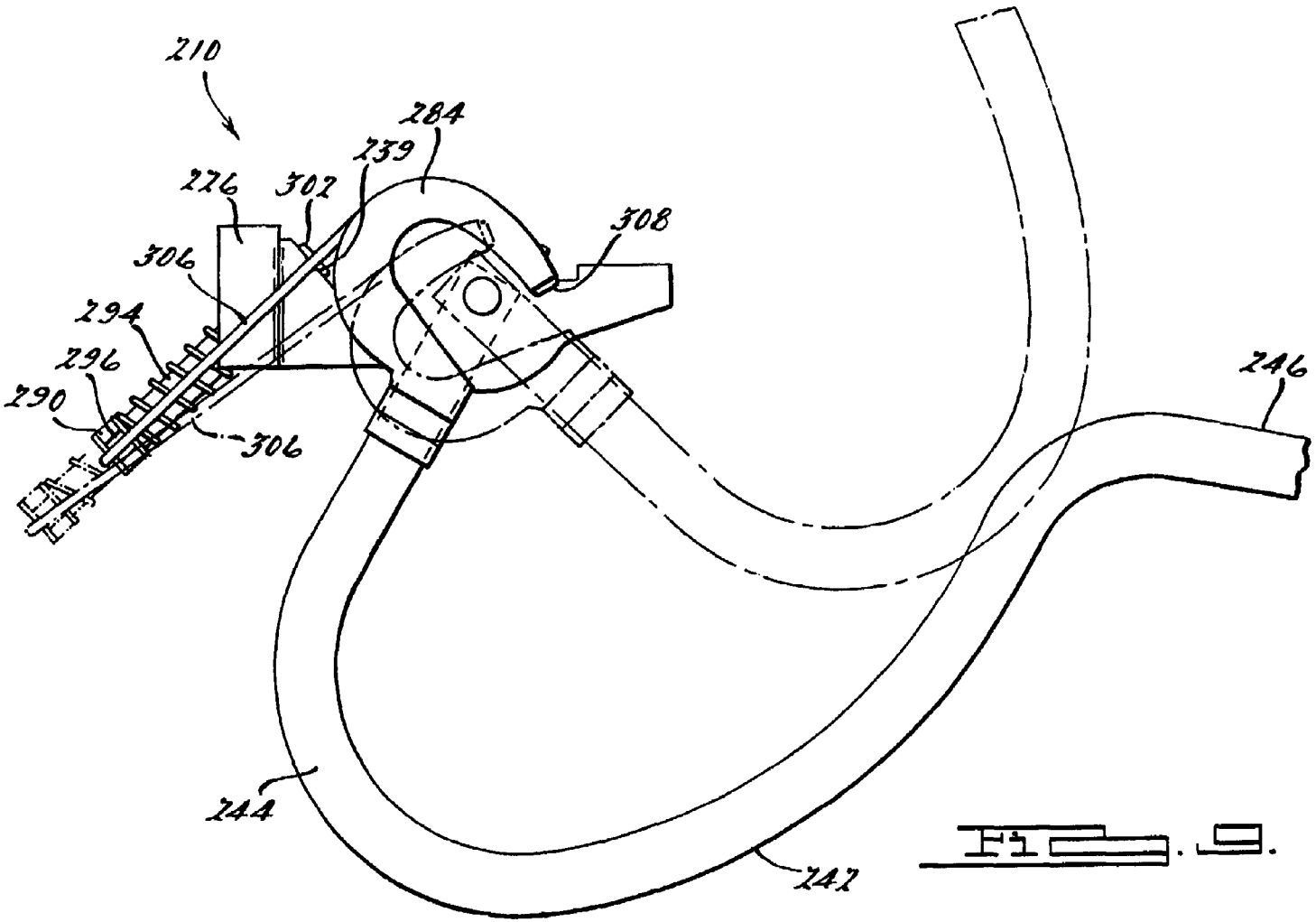
FIG. 9 is an elevational view of the gooseneck hinge assembly of FIG. 7 illustrated in a closed operating position and an open operating position.

Referring to FIGS. 7 through 9, yet another embodiment, according to the present invention, of the gooseneck hinge assembly 10 is shown. Like parts of the gooseneck hinge assembly 10 have like reference numerals increased by two hundred (200). In this embodiment, the gooseneck hinge assembly 210 includes a body side bracket or strap 226 mounted to the vehicle body 14. The body side strap 226 has a base portion 228 and a pair of opposed side portions 232 extending longitudinally from the base portion 228. Each of the side portions 232 has at least one aperture 234 extending therethrough for a function to be described. The body side strap 226 also has a first support portion 236 extending laterally between the side portions 232, a second support portion 238 spaced longitudinally rearward from the first support portion 236 and extending laterally between the side portions 232, and a third support portion 239 spaced longitudinally forward from the first support portion 236 and extending laterally between the side portions 232. Each of the first support portion 236, second support portion 238, and third support portion 239 have at least one, preferably a plurality of apertures 240 extending therethrough for a function to be described. The gooseneck hinge assembly 210 also includes at least one, preferably a plurality of fasteners (not shown) such as bolts to attach the body side strap 226 to the vehicle body 14.

The gooseneck hinge assembly 210 also includes a closure side bracket or strap 242 to allow the decklid 24 to be attached to the body side strap 226. The closure side strap 242 has a generally arcuate base portion 244 and an attachment portion 246 extending longitudinally from one end of the base portion 244. The base portion 244 has at least one, preferably a plurality of apertures 248 extending therethrough near one end thereof for a function to be described. The base portion 244 also has a pair of opposed slots 250 extending therein from one end thereof on sides adjacent the apertures 248. The gooseneck hinge assembly 210 also includes at least one, preferably a plurality of fasteners (not shown) such as bolts to attach the closure side strap 242 to the decklid 24.

The gooseneck hinge assembly 210 also includes at least one pivot pin 254 to pivotally attach the closure side strap 242 to the body side strap 226 at a forward end thereof. The pivot pin 254 extends through a pair of opposed apertures 234 and 248 of the body side strap 226 and the closure side strap 242, respectively.

The gooseneck hinge assembly 210 includes a cam pulley 280 connected to the closure side strap 242. The cam pulley 280 has a base portion 282. The base portion 282 is generally hollow and rectangular in shape. The base portion 282 has an aperture 283 extending therethrough to allow the base portion 282 to be disposed over one end of the base portion 244 of the closure side strap 242. The cam pulley 280 also has a pair of cam portions 284 spaced laterally and extending axially from the base portion 282. Each of the cam portions 284 has a generally inverted hook shape or "C" shape. Each of the cam portions 284 has a channel or groove 286 therein for a function to be described. Each of the cam portions 284 has an aperture 288 extending through a free end thereof for a function to be described. The cam pulley 280 is made of a rigid material such as metal. The cam pulley 280 is integral and one-piece.

The gooseneck hinge assembly 210 also includes a crosshead 290 for a function to be described. The crosshead 290 is generally "T" shaped. The crosshead 290 has a head portion 292 extending radially and a shaft portion 294 extending axially from the head portion 292. The head portion 292 is generally rectangular in shape and the shaft portion 294 is generally cylindrical in shape. The head portion 292 has a recess 296 extending radially inward from each radial end thereof. The shaft portion 294 has a cavity 298 extending axially therein for a function to be described. The crosshead 290 is made of a rigid material such as metal. The crosshead 290 is integral and one-piece.

The gooseneck hinge assembly 210 further includes a spring 268 to power the decklid 24 to an open position by applying a force to the closure side strap 242. The spring 268 is of a coil type. The spring 268 is disposed about the shaft portion 294 of the crosshead 290. It should be appreciated that the spring 268 applies a force to counterbalance the weight of the decklid 24.

The gooseneck hinge assembly 210 also includes a guide crosshead 300 cooperating with the crosshead 290. The guide crosshead 300 has a head portion 302 extending radially and a shaft portion 304 extending axially from the head portion 302. The shaft portion 304 extends through the aperture 240 in the third support portion 239 of the body side strap 226 and is disposed in the cavity 298 of the shaft portion 294 of the crosshead 290. The guide crosshead 300 is made of a rigid material such as metal. The guide crosshead 300 is integral and one-piece. It should be appreciated that the guide crosshead 300 is press-fit into the aperture 240 to secure the guide crosshead 300 to the body side strap 226 and the crosshead 290 moves relative to the guide crosshead 300.

The gooseneck hinge assembly 210 further includes a cable 306 cooperating with the crosshead 290 and cam pulley 180. The cable 306 is made of a flexible metal material. The cable 306 also has enlarged ends 308. The cable 306 extends over the head portion 292 of the crosshead 290 and through the recesses 296 in the head portion 292 of the crosshead 290. The cable 306 also extends through the channels 286 in the cam portions 284 of the cam pulley 280 and the apertures 288 therein such that the enlarged ends 308 are disposed adjacent the ends of the cam portions 284 of the cam pulley 280.

Referring to FIG. 9, the gooseneck hinge assembly 210 is shown in open (phantom lines) and closed. (solid lines) operating positions, respectively. With the gooseneck hinge assembly 210, to open the decklid 24, the user applies a force to the decklid 24 and the spring 268 applies a spring force to the closure side strap 242 via the crosshead 290, cable 300, and cam pulley 280 to open the decklid 24 to the open position. To close the decklid 24, the user applies a force to the decklid 24 and the spring 268 counter-balances the weight of the decklid 24 to move the decklid 24 to the closed position. It should be appreciated that the gooseneck hinge assembly 210 allows the decklid 24 to be rotated open and closed.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. A gooseneck hinge assembly for a closure of a vehicle comprising:

a body side strap adapted to be connected to a vehicle body of the vehicle;

a closure side strap having a gooseneck shape adapted to be connected to a closure for closing an aperture in the vehicle body;

a pivot pin to pivotally connect said closure side strap to said body side strap to allow rotational movement therebetween, said pivot pin having a head portion and a shaft portion, said head portion being disposed outside of side portions of said body side strap and said shaft portion extending through the side portions of said body side strap and through said closure side strap disposed between the side portions of said body side strap; and a clock spring disposed around said head portion of said pivot pin and interconnecting said body side strap and said closure side strap to counterbalance a weight of the closure when opening and closing the aperture.

2. A gooseneck hinge assembly as set forth in claim 1 including a spring pin connected to said closure side strap.

3. A gooseneck hinge assembly as set forth in claim 2 wherein said spring has a first end cooperating with said pivot pin and a second end cooperating with said spring pin.

4. A closure assembly for a vehicle comprising:

a closure; and a gooseneck hinge assembly comprising a body side strap adapted to be connected to a vehicle body of the vehicle, a closure side strap having a gooseneck shape connected to said closure, a pivot pin to pivotally connect said closure side strap to said body side strap to allow rotational movement therebetween, said pivot pin having a head portion and a shaft portion, said head portion being disposed outside of side portions of said body side strap and said shaft portion extending through the side portions of said body side strap and through said closure side strap disposed between the side portions of said body side strap, a spring pin connected to said closure side strap, and a clock spring disposed around said head portion of said pivot pin and having a first end cooperating with said head portion of said pivot pin and a second end cooperating with said spring pin to counterbalance a weight of said closure when moving said closure between an open position and a closed position.

5. A vehicle comprising:

a vehicle body having an aperture therein;

a closure for closing said aperture;

a gooseneck hinge assembly connected to said closure and said vehicle body comprising a body side strap connected to said vehicle body, a closure side strap having a gooseneck shape connected to said closure, a pivot pin to pivotally connect said closure side strap to said body side strap to allow rotational movement therebetween, said pivot pin having a head portion and a shaft portion, said head portion being disposed outside of side portions of said body side strap and said shaft portion extending through the side portions of said body side strap and through said closure side strap disposed between the side portions of said body side strap, and a clock spring disposed around said head portion of said pivot pin and having ends interconnecting said body side strap and said closure side strap to counterbalance a weight of said closure when moving said closure between an open position and a closed position.

6. A gooseneck hinge assembly for a decklid of a vehicle comprising:

a body side strap adapted to be connected to a vehicle body of the vehicle;

a decklid side strap having a gooseneck shape adapted to be connected to a decklid for closing an aperture in the vehicle body;

a pivot pin to pivotally connect said decklid side strap to said body side strap to allow rotational movement therebetween, said pivot pin having a head portion and a shaft portion, said head portion being disposed outside of side portions of said body side strap and said shaft portion extending through the side portions of said body side strap and through said decklid side strap disposed between the side portions of said body side strap;

a spring pin connected to said decklid side strap; and a clock spring disposed around said head portion of said pivot pin and having a first end contacting said head portion of said pivot pin and a second end contacting said spring pin to counterbalance a weight of the decklid when opening and closing the aperture.

* * * * *